United States Patent [19]

Ibrahim

[11] 4,424,685

[45] Jan. 10, 1984

[54] AUTOMATED ENERGY CONSERVING COVER FOR REFRIGERATED CABINET ACCESS OPENINGS

[75] Inventor: Fayez F. Ibrahim, Niles, Mich.

[73] Assignee: Tyler Refrigeration Corporation, Niles, Mich.

[21] Appl. No.: 256,996

[22] Filed: Apr. 24, 1981

[51] Int. Cl.[3] ..... A47F 3/04

[52] U.S. Cl. ..... 62/249; 160/23 R; 160/265

[58] Field of Search ..... 160/23, 81, 265; 135/5 AT; 62/249, 255, 256, 246; 312/116

[56] References Cited

U.S. PATENT DOCUMENTS

| | | | |
|---|---|---|---|
| 2,583,824 | 1/1952 | Dwinell et al. | 160/22 |
| 2,886,104 | 5/1959 | Swan | 160/68 X |
| 2,898,607 | 8/1959 | McGuire | 160/23 R X |
| 3,052,290 | 9/1962 | Orloff | 160/81 |
| 3,241,899 | 3/1966 | Donker | 160/23 R X |
| 3,317,259 | 5/1967 | Otis | 160/23 X |
| 4,026,121 | 5/1977 | Aokage et al. | 62/256 X |
| 4,188,964 | 2/1980 | Greer | 135/5 AT |
| 4,195,877 | 4/1980 | Duda | 135/5 AT X |
| 4,203,174 | 5/1980 | Shults | 160/23 R X |

*Primary Examiner*—William E. Tapolcai

*Attorney, Agent, or Firm*—LeBlanc, Nolan, Shur & Nies

[57] ABSTRACT

An automatically operated flexible barrier cover for the access openings of refrigerated display cabinets. The barrier cover limits the contact between the refrigerated air within the cabinet and the ambient air. The barrier cover can be moved over the access opening during non-customer use time periods when the retail food outlet is closed. The barrier cover can be arranged as a unitary assembly which can be manufactured and sold separately from the display cabinet as a retrofit device to effect energy savings.

The flexible barrier cover can be stored in a reeled-up position or can be arranged as a folded flexible barrier which can be fanned out across the access opening. Various traction means are provided for moving the flexible barrier across the access opening.

24 Claims, 14 Drawing Figures

Fig.1
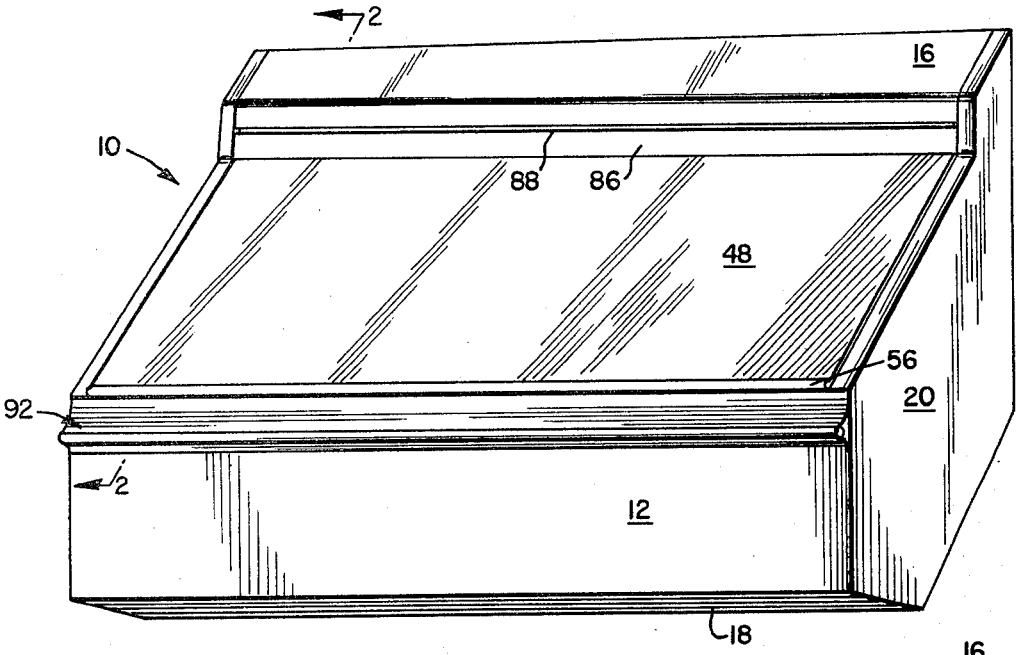
Fig.2
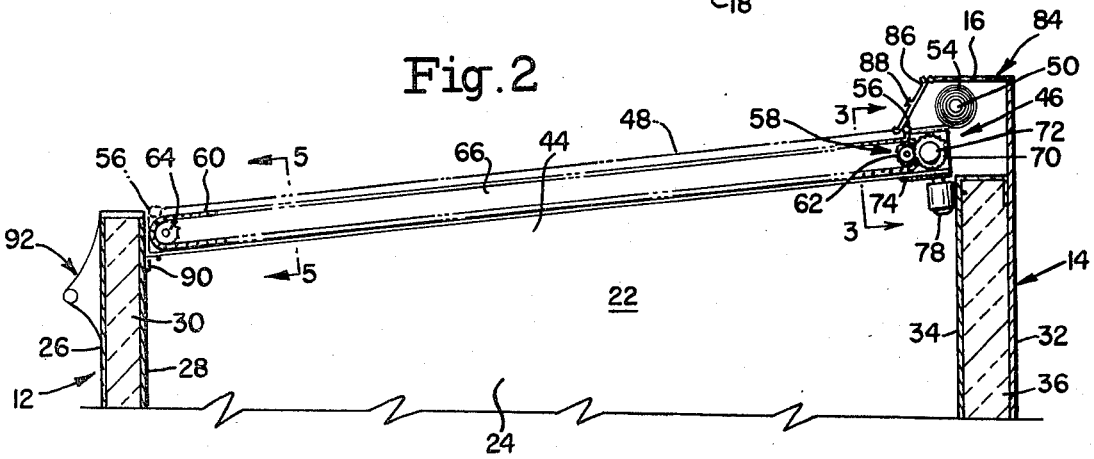
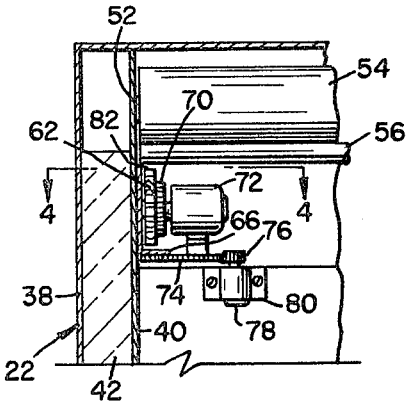
Fig.3
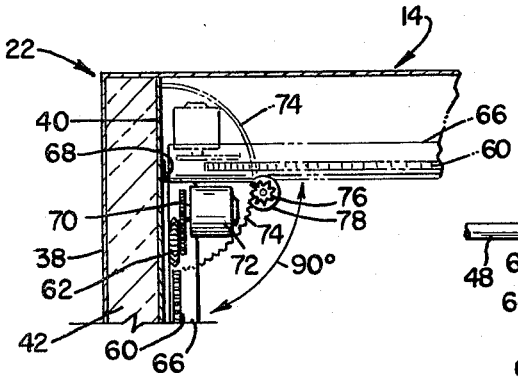
Fig.4
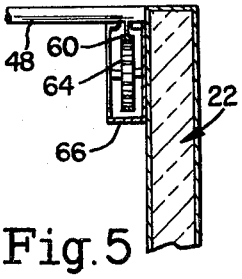
Fig.5

AUTOMATED ENERGY CONSERVING COVER FOR REFRIGERATED CABINET ACCESS OPENINGS

BACKGROUND OF THE INVENTION

The present invention relates to a flexible barrier cover assembly for use with "reach-in" merchandiser type of refrigerated display cases or cabinets used primarily in retail food and supermarket outlets. The operation of the barrier cover is controlled automatically according to the occurrence of selected conditions.

The term "refrigerated", in accordance with the present invention is intended to incorporate those cases maintained at a temperature at or in excess of 32° F., such as display cases utilized for the display of milk and fresh foods, and those cases maintained below 32° F., such as frozen food cases.

An increasing demand being made by managers of retail food stores or outlets is the reduction of the energy consumption of refrigerated display cabinets which are used in such outlets. Various approaches have been used to conserve the energy required to operate these display cabinets. When the display cabinet is operated as an open-top or an open-front cabinet to permit freer customer access to the stored products the refrigerated air contained within the cabinet is in direct contact with the ambient air. Heat and moisture transferring from the ambient air into the air bands circulated within such open cabinets are responsible for a large fraction of the heat loads. Restriction of this transfer process by the use of heat barriers is thus considered desirable.

Open-top and open-front cabinets incur high operating energy costs both during the customer use periods when the retail outlet is open and those non-use hours when the outlet is closed. One approach to the problem of the high energy expense of operating the refrigerated cabinet during non-use time periods is shown in U.S. Pat. No. 4,109,484 to Cunningham and 4,141,611 to DeLeon in which protective barrier covers are manually hung over the access opening of refrigerated display cases by the retail employees.

Another approach to solving this problem has been to incorporate a manually movable cover means within the structure of the refrigerated display cabinet as shown by U.S. Pat. Nos. 2,773,357 to Canter; 3,186,185 to Bently et al; 3,241,899 to Donker; 3,403,525 to Beckwith et al; and 4,117,698 to Vogel.

A problem with the devices disclosed in the patents set forth above is that the barrier covers must be manually moved into the blocking positions which then necessitates the retail outlet personnel remembering to take this action at the beginning of the non-use time period. In modern retail food supermarkets there are a large number of refrigerated display cabinets which then requires a significant time expenditure on the part of the personnel in order to effect the potential energy savings by the use of such manually employed barrier covers. The twice daily necessity for moving the barrier covers subjects them to tearing, ripping and general physical deterioration. Storage of such large sheet materials is also regarded as a problem by the operating managers and personnel.

Another, somewhat more complicated solution, to this problem is suggested in U.S. Pat. No. 2,994,572 to Morrison in which a photoelectric cell control circuit is employed to open barrier doors for permitting customer access to the stored products. This type of system requires a large portion of the refrigerated display cabinet structure to be employed as a door storage space. The control circuitry is also complicated.

Various cover, lid, and door arrangements have been proposed for refrigerated display cabinet as shown by U.S. Pat. Nos.: 2,001,106 to Mullen; 2,041,258 to Mitchell; 2,081,048 to Bate; 2,175,839 to Hopkins; 2,518,134 to Fredenhagen et al; 2,669,851 to Pichler; 2,694,613 to Williams; 3,273,585 to Patch; 3,359,050 to Dongus; 3,360,316 to Swanson; and 4,186,790 to Schenker et al. However, these patents do not provide for the automated operation of the cover means to protect the refrigerated air from contact with the ambient air without the attendance of store personnel.

A flexible door for a storage cabinet in which the door is operated by motor means is shown in U.S. Pat. No. 3,317,259 to Otis. However, the cabinet is not refrigerated and the motor is controlled by means of a manually operated switch which does not permit automated openings and closings controlled by selected use conditions. This patent does not disclose the automated operation of protective barrier covers for refrigerated display cabinets in retail food outlets. Yet, in order to derive the potential energy conserving advantages from such covers practice has indicated that the present manually operated covers are inadequate.

The above difficulties are overcome by the automated conserving barrier covers of the present invention in a manner to realize the potential energy savings of such covers and to effect a more cost efficient operation due to the lower requirements for personnel time expenditure.

In the operation of all types of refrigerated display cabinets, it is desirable to include a system for automatically defrosting the refrigeration coils. The defrost cycle can be actuated either at set periodic time intervals or when the frost build-up within the system has reached a certain predetermined level. Such systems are typically thermostatically controlled so as to switch from a refrigerated cycle to a defrost cycle of operation. In this manner of operation it is possible to avoid any significant frost build-up within the display cabinet such that inoperability and spoilage of food products would occur.

There have been three different approaches for defrosting refrigerated display cabinets in this art, utilizing the electric resistance heaters; passing a compressed refrigerant gas having a high specific heat through the refrigeration coils; and, circulating ambient air through an air conduit in which the refrigeration coils are positioned. Due to the increased cost of energy, efforts have been made to place more emphasis on the utilization of ambient air defrost systems as an alternative to the electric resistance heaters or compressed refrigerant gas defrost systems.

The present invention is useable with all three of these defrost systems. The automated protective barrier cover can be arranged for covering the access opening of refrigerated cabinets which also contain air defrost systems in such a manner that the cover is retracted automatically at the beginning of a defrost cycle in order to permit the flow of defrost air through the access opening of the cabinet. Such defrost cycles frequently occur during the non-customer use time periods during which the store is closed. Thus, the automated feature of the present invention permits the use of the protective barrier cover with air defrost refrigerated cabinets. In a manually arranged cover system such air defrost through the access opening is not practical since store personnel are not present during the periods when the store is closed.

SUMMARY OF THE INVENTION

An improvement in refrigerated display cabinets is presented in which an automatically operated flexible barrier cover is moved into and out of a closed position across the access opening of the display cabinet. The barrier cover limits the contacting of the refrigerated air within the cabinet by the higher temperature and humidity ambient air. The barrier cover is moved over the access opening during non-customer use time periods with the exception of those periods during which air defrost systems require the access opening as a flow port.

The flexible barrier cover can be arranged as a unitary assembly which can be manufactured and sold as a separate item of commerce and designed for insertion along one side of the access opening of refrigerated cabinets already in service, thus, providing a retrofitting possibility for such cabinets already installed in retail outlets to effect energy savings. It is also possible to incorporate the barrier cover assembly into original manufactured equipment whereby the energy savings benefits of the present invention are immediately available during the life of the cabinet.

Several forms of support and motive means for drawing the barrier cover across the access opening are set forth.

It is therefore, an object of the present invention to provide an improvement for refrigerated display cabinets in which a barrier cover is automatically moved across the access opening in order to limit contact between the ambient air and the refrigerated air within the cabinet.

Another object of the present invention is to provide a flexible barrier cover assembly which does not require regular personnel operation in order to effect the energy conserving results obtainable therefrom.

Yet another object is to provide a flexible barrier cover which is automatically transported across the access opening by a traction means in the form of an endless chain or belt secured on a support.

Another object is to provide a screw operator and follower-sleeve traction means for moving the flexible barrier cover.

A further object is to provide one or more fan-shaped barrier covers supported on a plurality of rails for moving into and out of a blocking position across the access opening of a refrigerated display cabinet.

Specific preferred embodiments of the invention will be described below with reference to the appended drawing figures.

BRIEF DESCRIPTION OF THE DRAWINGS

FIG. 1 is a schematic perspective view of an open-top refrigerated cabinet fitted with a flexible barrier cover in closed position according to the present invention;

FIG. 2 is a cross-sectional elevation view of the cabinet of FIG. 1 taken on lines 2—2;

FIG. 3 is a cross-sectional fragmentary view of the cabinet taken on line 3—3 of FIG. 2;

FIG. 4 is a fragementary cross-sectional view taken on line 4—4 of FIG. 3 showing a pivotal support means for the barrier cover;

FIG. 5 is a cross-sectional fragementary view taken on line 5—5 of FIG. 2 showing the idler gear arrangement for the barrier cover motive means;

DESCRIPTION OF THE PREFERRED EMBODIMENTS

Figure 6:
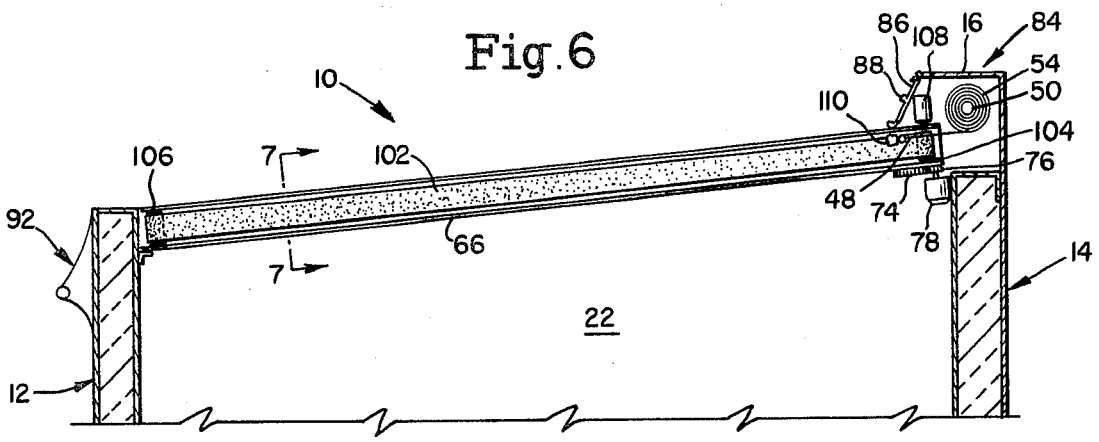
FIG. 6 is a cross-sectional elevation schematic view of a second modification of the support and motive means for the automated barrier cover.

Referring now to FIGS. 1–5, a refrigerated cabinet 10 is shown with front wall 12, rear wall 14, a narrow top wall 16, and bottom wall 18 and with end walls 20 and 22 all of which define a product display and storage space 24. The outer walls can be constructed of sheet metal surfaces as shown with respect to front wall 12 such as outer layer 26 and inner layer 28 with an insulated core member 30. Similar construction is employed for rear wall 14 by means of an outer layer 32 and inner layer 34 and insulated core 36. End wall 22 can be similarly constructed with an outer layer 38 and inner layer 40 and an insulated core 42 as shown in FIGS. 3 and 4.

Refrigerated display cabinets such as illustrated by cabinet 10 are normally equipped with refrigeration coils and air moving means to provide a circulated refrigerated air band within product storage and display space 24. Such circulation air band cabinets are described in U.S. patent application Ser. Nos. 84,858 filed Oct. 15, 1979; 101,069 filed Dec. 7, 1979; 141,359 and 141,360 both filed Apr. 18, 1980 in the name of the inventor hereof. The disclosures of all of these applications are hereby incorporated by reference as though fully set forth herein. In some of those refrigerated display cabinets barrier doors are incorporated into the design and operation of the cabinets.

Refrigerated cabinet 10 has an access opening 44 which is horizontally disposed between front wall 13, rear wall 14 and the two side walls 20 and 22. A flexible barrier cover assembly 46 is designed to fit under top wall 16 and along the upper inside portions of end walls 20 and 22. Assembly 46 includes a flexible barrier cover 48 which can be unreeled from a core member 50 which is rotatably affixed between the end walls 20 and 22 as shown by bearing 52 in FIG. 3. Barrier cover 48 is shown in extended position across access opening 44 in FIGS. 1, 2 (in phantom) and 5 in the reeled-up position 54 in FIGS. 2 and 3. One end of the flexible barrier cover 48 is attached to core member 50 and the opposite end is attached to a cover rod 56 which is in turn connected to a traction means 58. Traction means 58 is constructed with an endless drive member 60 which can be in form of a belt or chain in tension between a drive gear 62 positioned under core member and an idler gear 64 positioned adjacent to the inside surface of front wall 12. The gears 62 and 64 are mounted near the ends of a pivotable rail 66 which is attached to end wall 22 by a hinge 68 as shown in FIG. 4. A traction gear 70 is also rotatably mounted on rail 66 at the rear-most end portion thereof. Traction gear 70 is powered by motor 72 which therefor pivots with rail 66. Traction gear 70 meshes with a drive gear which is co-axially connected to gear 62 and provides power therefor to enable linear movement of endless drive member 60.

A segmental gear 74 is integrally affixed to the bottom surface of rail 66 along one edge portion thereof. Segmental gear 74 is operated by a drive gear 76 which is, in turn, powered by a second motor 78 which is positioned on the inside surface of rear wall 14 by hold-down bracket 80.

The cover rod 56 is connected to endless drive member 60 by a connector 82 shown in FIG. 3 which provides for rotary motion about its vertical connection axis.

A second pivotable rail and an endless drive flexible barrier cover assembly member are positioned on the opposite side of the access opening 44 and are positioned adjacent to the top portion of end wall 20 when said barrier cover is in closed position as shown in FIG. 1. The second rail and drive member together with the flexible cover 48 form a second barrier cover assembly.

In operation, the two barrier cover assemblies and their associated support rails, such as shown by rail 66, are housed within ther rear housing 84 which is formed by the extension of rear wall 14, top wall 16, and a hinged cover plate 86 which is provided with a finger-grip 88. When the support rails are stored within housing 84 in compact form, they are in a position parallel to rear wall 14 as shown by the phantom lines in FIG. 4.

Motors 72 and 78 are connected to a control means (not shown) which operates the motors depending upon the occurrence of selected conditions. Such conditions can be the initiation of the food outlet closing time, or the operation of other equipment which is normally terminated at the end of an open period for the outlet. Upon the occurrence of a selected condition, the control means actuates the motor 78 which in turn causes segmental gear 74 to pivot support rail 66 and the cooperating rail located on the opposite side of the access opening outwardly into and across the access opening. This action then forces cover plate 86 upward as the two rails pivot away from their stored, closed position under top wall 16. The pivoting of rail 66 swings the rail across the access opening 44 and into abuttment with the top portion of end wall 22. A support bracket 90 is provided on the inner surface of front wall 12 in order to provide structural support for the extended support rail 66. Pivotal connector 82 can also be constructed of a flexible material such as an elastomer in order to better accommodate this pivoting motion of support rail 66 and to facilitate connecting the cover rod 56 to the endless drive members.

After completion of the pivotal movement of the support rails into the positions shown in FIGS. 2–5, the traction motor 72 is actuated by the control means to move the endless drive member 60 whereby the flexible barrier cover 48 is unreeled across the access opening 44 from the rear-most to the forward-most position as shown by the phantom lines in FIG. 2 and as shown by the solid lines in FIG. 1. When cover rod 56 reaches the forward most position as shown by the phantom lines in FIG. 2, traction motor 72 is turned off by an input signal from a limit switch or an overload condition upon the cover rod 56 coming into contact with front wall 12.

The barrier cover 48 remains in covering position across access opening 44 during the non-use time period which is normally the closed hours for the retail outlet. If it is necessary to defrost the cabinet 10 by use of ambient air drawn into the cabinet or expelled from the cabinet through the access opening 44, a provision in the control means can be made so that the barrier cover 48 will be retracted in order to open the access opening for the flow through of ambient air. At the beginning of the next use cycle of the cabinet 10 control means are provided for first operating traction motor 72 in a reverse direction in order to draw barrier cover 48 back into its reeled-up form 54. It is necessary to provide rotary power for the core member 50 by means of either a spring which is biased against unreeling of the cover 48 or by directly powering the core member 50 for rotation either by a take-off from traction motor 72 or a separately supplied motor means (not shown). Upon the completion of the retraction of barrier cover 48 across access opening 44, the pivotal motor 78 is then operated to cause segmental gear 74 to rotate across the access opening 44 about hinge 68 in order to return the support rail 66 to its stored position within housing 84. The cover plate 86 is designed to automatically return to a closed position.

Cabinet 10 can also be fitted with a front wall skirt and rub rail assembly 92 as shown in FIG. 2. If desired, traction motor 72 can be affixed to support rail 66 by an internal fixed post or it can be mounted by an external bracket (not shown) which can then be secured on the end portion of support rail 66. Also, if desired, the pivotal motor 78 can be secured to a portion of the barrier cover assembly 46 rather than to the rear wall 14 as shown. In that construction, the entire barrier cover assembly 46 can be housed in a separate housing which is then fitted into the existing housing 84 or is utilized for an independent housing which is affixed along the length of the top rear portion of the open-top refrigerated display cabinet 10. According to that manner of construction, the barrier cover assembly can be manufactured and sold as a separate item of commerce.

An alternative to this type of construction is that the support rails and endless drive members can be fixed in the position shown in FIGS. 1–3 and 5 against end walls 20 and 22. If desired, cover members for partially or fully enclosing these elements can also be used and portions of the cabinet structure can be used as support rails.

Figure 7:
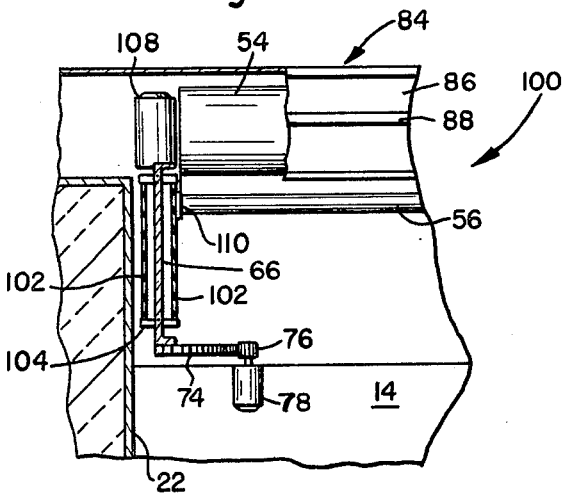
FIG. 7 is a schematic cross-sectional view taken on line 7—7 of FIG. 6 showing the support and motive means.

Referring now to FIGS. 6 and 7, a second embodiment of the support and traction means of the invention is illustrated. Consistent numerical designations with respect to FIGS. 1–5 have been employed for the common elements shown in FIGS. 6 and 7.

In this embodiment, a pivotal support rail 66 is swung across access opening 44 by a segmental gear 74 powered by a motor 78 which can be constructed in the various manners set forth with respect to FIGS. 1–5 above. An endless drive member 102 is shown in tension between two vertically oriented rollers 104 and 106 which are positioned at opposite ends thereof. The rear most roller 104 is connected to a motor 108 which is vertically mounted on the rear most ends of support rails 66. The support rails 66 can be mounted for pivotal motion in a manner similar to that described with respect to FIGS. 1–5 above and a cooperating support rail is also provided for the opposite side of access opening 44 whereby that rail is positioned adjacent the top most portion end wall 20 when support rail 66 is in the position shown by FIGS. 6 and 7.

The endless drive member 102 has a hinged connector 110 affixed thereto by one of the hinge leaves. The other hinge leaf is affixed to cover rod 56 so that the flexible barrier cover 48 is transported across access opening 44 under motive power derived from motor 108 when support rail 66 is in the extended position. As in FIGS. 1–5, the support rail 66 is swung pivotally into position under motive force derived from motor 78 which acts upon segmental gear 74. The endless drive member 102 has the advantage of a slightly simpler construction than the endless chain 60 described with respect to FIGS. 1–5 and provides for improved customer safety. If desired, a flexible elastomeric connector can be substituted for hinge 110 in order to accommodate for positional adjustments.

Figure 9:
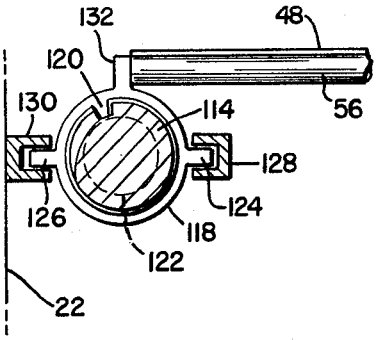
FIG. 9 is a fragmentary cross-sectional view taken on line 9—9 of FIG. 8 showing the screw operator and follower sleeve of the support and motive means.
Figure 8:
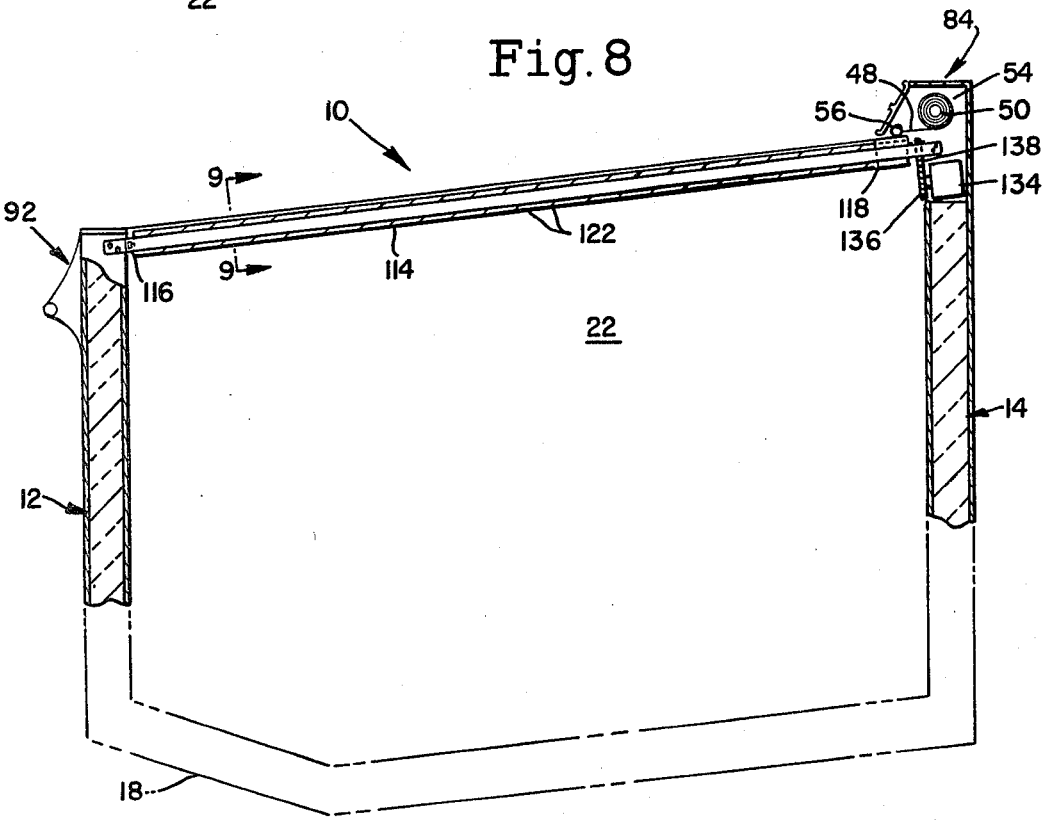
FIG. 8 is a cross-sectional elevation view of a third modification of the barrier cover support and motive means.

FIGS. 8 and 9 show a third modification of the motive means and the support means for the flexible barrier cover 48. Consistent numerical designations have been employed for illustrated elements in common to FIGS. 1–7.

A refrigerated display cabinet 10 is shown with a screw operator 114 arranged along the upper inside portion of end wall 22. A similar screw operator is provided for the opposite side of the access opening 44. The screw operator 114 is rotatably mounted along the access opening by a front wall pin 116 and a similar rear wall pin (not shown). A follower sleeve 118 is arranged in threaded contact with screw operator 114 and is provided with one or more lugs 120 which follow in the grooves provided by threads 122. Follower sleeve 118 has inner and outer ears 124 and 126 which fit into inner and outer retainer members 128 and 130 respectively. The screw operator 114 and the retainer members 128 and 130 can be secured in positions adjacent to the end walls such as shown with respect to end walls 22 in FIG. 9 or these can be mounted for pivotal movement in the manner illustrated and described with respect to FIGS. 1–7 above. A cover rod 56 and a flexible barrier cover 48 are affixed to the upper portion of follower sleeve 118 by a connector member 132 which can have a rotatable feature. A motor 134 is provided under housing 84 as shown in FIG. 8 for operating a drive gear 136 which, in turn, contacts the end gear 138 which is the drive gear for screw operator 114. As in FIGS. 1–7, the flexible barrier cover 48 is reeled about core member 50 into a rolled form 54.

The screw operator and follower sleeve combination illustrated and described in FIGS. 8 and 9 has the advantage of improved structural stability and positive force exerted in both directions of movement but at a slightly increased equipment cost. This combination provides the rail support for the barrier cover. Core member 50 is spring-biased against unreeling.

Figure 11:
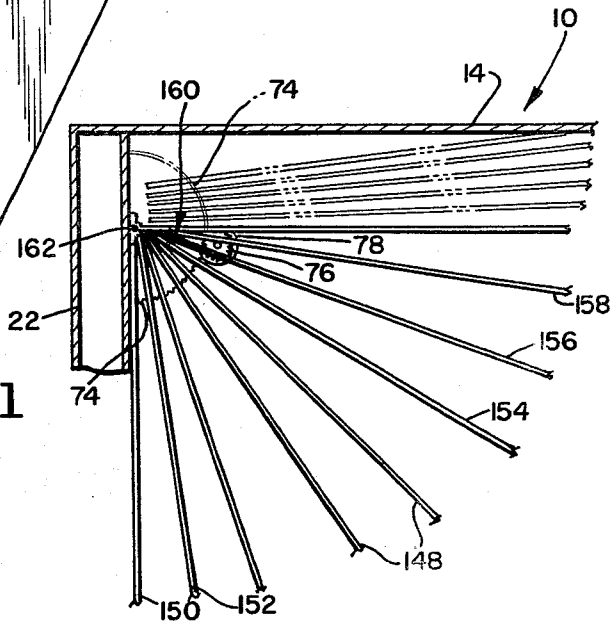
FIG. 11 is a top cut-away view of the cabinet and barrier cover assembly of FIG. 10 wherein the barrier cover has been removed to show the details of the support structure and motive means.
Figure 10:
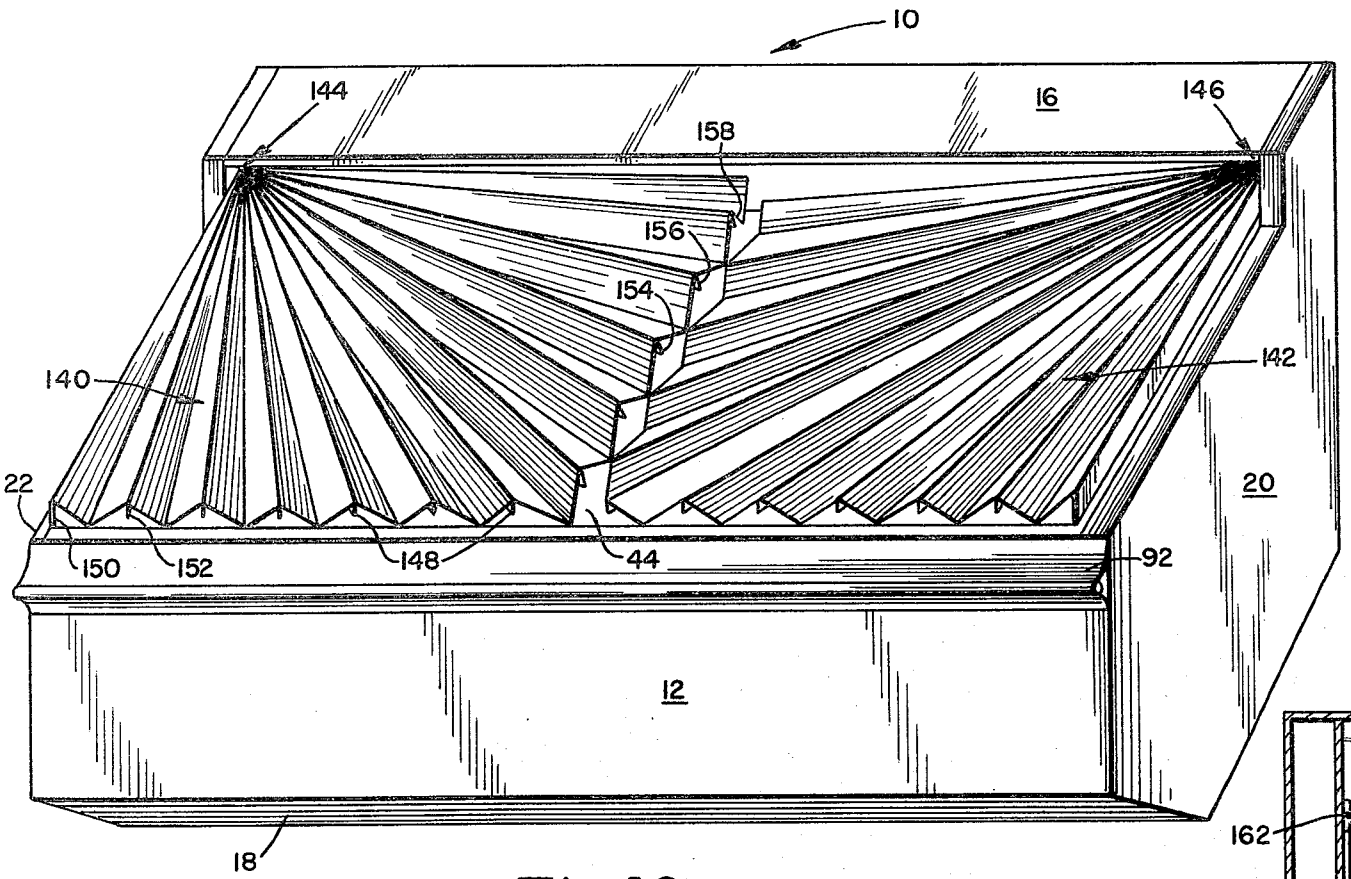
FIG. 10 is a schematic perspective view of a refrigerated cabinet equipped with another modification of the automated barrier cover of the present invention.

FIGS. 10 and 11 illustrate a fourth embodiment of the present invention wherein the flexible barrier cover assembly is constructed by dividing the barrier cover into two accordion-folded portions 140 and 142 which are pivoted about opposite rear corners 144 and 146 of a refrigerated display cabinet 10. The two cover portions 140 and 142 are positioned in planes spaced one above the other to the top and the bottom of a reference plane so that the end portions of the accordion-folded barrier cover do not interfer with one another upon fanning out over the access opening 44.

The accordion-folded cover portions 140 and 142 can be constructed of a thin flexible material such as plastic sheeting having thermally deformed fan-shaped accordion-folds therein. It is also possible to join individual panel members along the edges thereof by flexible hinge material and for such constructions the members may be of rigid plastic or metal. These two cover portions 140 and 142 are attached to the inside of rear wall 14 and are connected to the upper surfaces of two sets of support rails one of which is illustrated in FIG. 11. In this modification, the segmental gear 74 is utilized to support a number of support rails 148 which are arranged in fan-shaped configuration. The rails 150 and 152 which are closest to end wall 22 when the barrier cover is extended across the access opening 44 can be arranged in fixed positions on segmental gears 74. The other support rails illustrated by rails 154, 156, and 158 are pivotally affixed to segmental gear 74 as shown by the pivotal connection points generally designated as 160 so that the rear most support rails are foldable or collapsible against the inner surface of rear wall 14 when segmental gear 74 is moved to the phantom line position illustrated in FIG. 11. As in FIGS. 1–7 a motor 78 and a drive gear 76 are provided for the movement of segmental gear 74. The support rail 150 and the segment gear 74 are pivotally connected to the inner wall 22 by a hinge member 162.

While the use of the accordion-shape cover portions 140 and 142 necessarily leaves an air gap therebetween through which ambient air can contact the refrigerated air within the cabinet 10, the flexible cover still provides a substantial percentage of the energy conserving potential of such an automatic operating flexible cover assembly. In addition, this modification provides the additional advantage of operating with only a single motor (78) for each of the two cover portions. This embodiment is also easily packaged in a unitary housing which can be easily retrofitted into existing refrigerated display cabinets which are already in service. As in flexible barrier cover assemblies described with respect to FIGS. 1–9, the associated control means actuates the motor 78 upon the occurrence of selected conditions such as the closing of the retail outlet at specific times. The cover portions 140 and 142 can also be retracted during air defrost cycles of operation for cabinet 10.

While the assemblies illustrated and described in FIGS. 1–11 have been shown in horizontal planes for use on open-top display cabinets it is also possible to employ the same elements in a vertical arranged plane for open-front display cabinets. For such employments, it is useful to provide an additional hold-up chain or cord which connects to the ends of the support rails and is wound onto a drum fitted into the housing structure toward the rear of the reeled-up flexible barrier cover.

Figure 12:
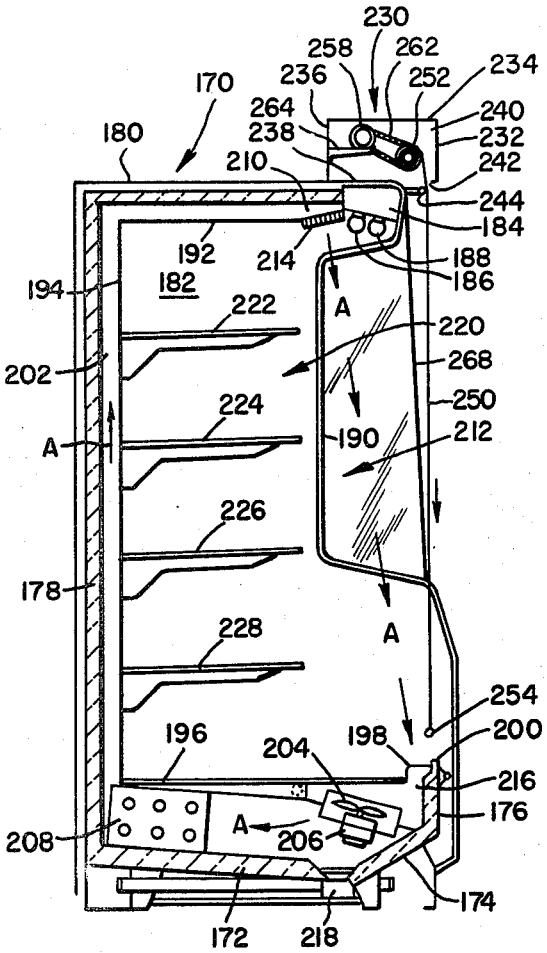
FIG. 12 is a schematic cross-sectional view of an open front refrigerated cabinet equipped with another modification of the automated barrier cover of the present invention.
Figure 13:
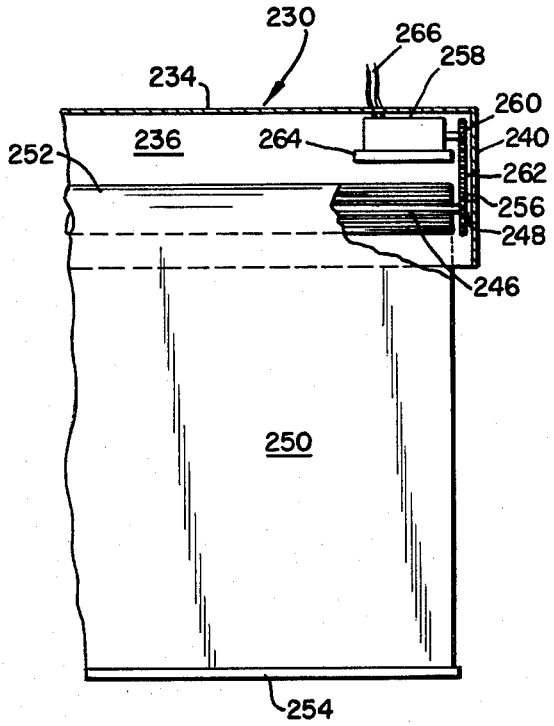
FIG. 13 is a fragmentary front elevation view of the automated barrier cover illustrated in FIG. 12.

FIGS. 12 and 13 show another embodiment of the flexible barrier cover assembly which is specifically designed for open front refrigerated cabinets for which the movement of the barrier cover is in a vertical plane across the access opening. A refrigerated display cabinet 170 is constructed with a bottom wall 172 which has an upwardly inclined front portion 174 connected to the lower front wall 176. The rear edge of bottom wall 172 is connected to a vertical rear wall 178 is connected to a top wall 180 at its upper edge. An end wall 182 is shown as one of the two end walls which complete the construction of the cabinet 170. A top lighting cowl 184 is attached to the front edge of the top wall 180 and contains fluorescent light bulbs 186 and 188. End wall 182 has a trim member 190 formed around the top, front, and bottom portions thereof.

A top inner panel 192 is spaced from the bottom side of top wall 180 and is connected along the rear edge thereof to a rear inner panel 194 which extends parallel to rear wall 178 and is connected at the bottom edge thereof to a bottom panel 196 which, in turn, is connected by its front edge to an air grille 198. This air grille is connected to the front upper edge portion 200 of the front wall 176. The spacing of the inner panel members 192–196 from the outer cabinet walls 172–180 forms an air conduit 202 in which an air band A is circulated during the refrigeration cycle by an air fan 204 driven by a motor 206. The air band A is propelled through an evaporator coil box 208 which is connected within a refrigeration system (not shown). The air band A is expelled from conduit 202 through air outlet 210 located under the front portion of top wall 180 and is directed across the front access opening 212 by downwardly directed louvers 214. The air band A is drawn into conduit 202 through air grille 198 at the bottom of the access opening 212 through an air inlet port 216 located immediately below the air grille 198. A conventional drain system 218 can be connected to the bottom wall 172 in order to provide for condensate run-off when the evaporator coil box 208 is being defrosted.

In order to protect the display space 220 in which refrigerated products are stored on bracket-supported shelves 222, 224, 226 and 228 from contact with the ambient air during the time periods when the store is closed a flexible barrier cover assembly 210 is installed on the top portion of top wall 180 overlying the lighting cowl 184. This assembly 230 consists of an outer housing constructed of a front wall 232, a top wall 234, a rear wall 236 and a bottom wall 238. An end wall 240 is shown as one of the two end walls to complete the assembly housing. An opening 242 is formed in bottom wall 238 along the front portion thereof and a roller member of a bead 244 is formed on the front edge of the bottom wall 238. A rotatable core member 246 is attached to the end walls of the assembly housing by two bearings illustrated by the bearing 248 for end wall 240 in FIG. 13. The flexible barrier cover 250 can be taken up on core member 246 and stored in the reeled-up position 252. A weighted member 254 is attached to the bottom end of flexible barrier cover 250 in order to allow the flexible barrier cover to remain in a controlled plane independently of external air currents. Core member 246 is rotated by a end idler gear 256 which is, in turn, powered by an electric motor 258 through a drive gear 260 and a drive chain 262. It is to be understood that the gear and drive chain mechanism can also be replaced with a suitable tooth gear and belt or a pully and belt arrangement.

Motor 258 is supported within the assembly housing 230 by bracket 264. Motor 258 is supplied with power by leads 266 in order to cause the motor to operate in either rotational direction to raise and lower the flexible barrier cover 250 according to the requirements of customer access into the display cabinet 170 and to the requirements for air defrosting of the evaporator coil box 208. When an air defrost cycle is to be used and air is to be drawn in through the access opening 212 for defrost purposes, the flexible barrier cover 250 can be reeled upwardly and stored in the reel-up position 252.

The weighted member 254 can be in the form of a metal bar or a dense granular material in a rod-shape flexible covering. The weight member 254 is utillized to direct the flexible barrier cover 250 downwardly directly onto the top surface of air grille 198 as shown in FIG. 12. The material of the flexible barrier cover 250 can be any of a wide variety of plastic film materials such as polyvinylchloride which is largely impervious to moisture transfer therethrough or can be constructed of a woven fabric such as canvas. If desired, a spring return means can be incorporated into the connection of core member 246 with the housing end wall 240 in order to allow for a full or partial return of the flexible barrier cover into the reeled-up position under force exerted by the spring system.

The assembly housing 230 is a self-contained unit which can be used to retrofit refrigerated cabinets 170 which are already in service in retail food outlets. The assembly housing 230 can be placed on top of the display cabinet and connected by fasteners such as screws or metal brads and the electrical power leads 266 connected to a control circuit.

If desired, side panels 268 can be constructed or glass or plexiglass and inserted in the C-shaped indentation in end wall 182 in order to further restrict the contact of the ambient air during the non-customer use time periods when the flexible barrier cover is in the closed position. These end panels are of a fixed type.

The flexible barrier cover described herein can also be spaced parallel from or at angles to the plane of the covered access opening, if desired by design differences.

The flexible barrier cover assemblies illustrated and described in FIGS. 1–13 enable an approximate 25% annual energy savings in the operation of refrigeration display cabinets which have uncovered access openings therein. The covers are automatically extended into covering positions over the access opening during the non-customer use time periods in order to exclude the transfer of sensible heat and moisture from the ambient air as well as radiation energy inflow.

If desired, the elements of the assembly illustrated and described herein can be packaged in a elongated housing which will fit under the top wall cowl and between the end walls of existing refrigerated display cabinets. Such a discreet package form or housing can have a cross-section of approximately 5" by 5" in dimension. The assembly housing is thus of a unitary, modular form.

Figure 14:
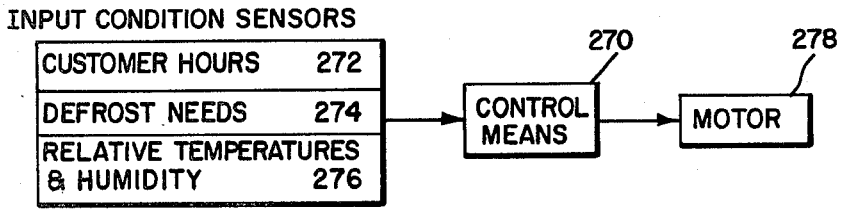
FIG. 14 is a block diagram of the automatic control means for actuating the motive means.

FIG. 14 shows the barrier cover assembly control means 270 sensing various input conditions through positioned sensors 272, 274, and 276. The control means then automatically actuates the motor 278 to operate the flexible barrier covers 48, 140, 142, and 250 of the various figures. Motor block 278 corresponds to motors 72, 78, 134, and 258. One or several of the condition sensors can provide input signals for the control means 270.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. In a refrigerated display cabinet having outer walls defining a product storage and display space containing refrigerated air and having an access opening in at least one wall thereof to provide for product access; the imrovement comprising:

an energy conserving assembly including a flexible barrier cover arranged for covering at least a portion of said access opening and adapted for storage away from said access opening, a support means for providing structural support for and enabling movement of said flexible barrier cover from the storage position across at least a portion of said access opening and having at least two rails for supporting said flexible barrier cover, motive means for powering the movement of said flexible barrier cover, control means for actuating said motive means in response to the occurrence of selected operational conditions to enable movement of said barrier cover across said access opening whereby contact of ambient air with the refrigerated air contained within said product storage and display space is substantially limited, and traction means arranged for movement relative to at least one of said rails and wherein said traction means are connected to said motive means for enabling said traction means to be powered during times determined by said control means, and wherein said flexible barrier cover is connected to said traction means and is withdrawn from stored position by power derived from said motive means.

2. The improvement according to claim 1, wherein separate traction means are arranged for movement along both of said rails and a cover rod is connected between said traction means for enabling movement of said rod across said access opening, and wherein said flexible barrier cover is connected to said cover rod.

3. The improvement according to claim 2, wherein said support means consists of two rails for supporting said flexible barrier cover and each of said rails is pivotally supported within said cabinet and movable between positions adjacent to the edges of said access opening, and said support means including two pivoting means for moving each of said rails over arcs having centers located near two corners of said access opening, said traction means enabling movement of said flexible barrier cover across said access opening upon completion of movement of said pivoting means, said control means upon input of a cabinet non-use condition controls the movement of said pivoting means to enable each of said rails to move over pivot arcs away from stored positions adjacent to said access opening and across at least a portion of said access opening.

4. A refrigerated merchandiser cabinet having side, top, bottom and end walls defining a product storage and display space containing refrigerated air and having an access opening in at least one wall thereof to provide for product access; comprising an energy conserving flexible barrier cover arranged for covering at least a portion of said access opening and adapted for storage away from said access opening, a support means for providing structural support for and for enabling movement of said flexible barrier cover from the storage position across at least a portion of said access opening and having at least two rails for supporting said flexible barrier cover, motive means for powering the movement of said barrier cover, control means for sensing the occurrence of nonuse cabinet conditions for said cabinet connected to said motive means for controlling the operation thereof and for enabling movement of said barrier cover across said access opening whereby contact of ambient air with the refrigerated air contained within said product storage and display is substantially limited, and an endless drive member is arranged for movement along at least one of said rails and is operatively connected to said motive means whereby said drive member is powered during times determined by said control means, and wherein said flexible barrier cover is connected to said drive member and is withdrawn from storage position by power derived from said motive means.

5. The merchandiser cabinet according to claim 4, wherein separate endless drive members are arranged for movement along both of said rails and a cover rod is connected between said drive members for enabling movement across said access opening under power derived from said drive members, and wherein said flexible barrier cover is connected to said cover rod.

6. The merchandiser cabinet according to claim 4, wherein said refrigerated merchandiser cabinet contains at least one set of inner panels spaced from said side, top, and bottom walls to form a refrigerated air conduit within said cabinet, said conduit having air inlet and outlet openings at parallel edges of said access opening, and air moving means contained within said conduit for circulating a refrigerated air band within said conduit.

7. The merchandiser cabinet according to claim 4, wherein said access opening is positioned in a horizontally-oriented plane and said flexible barrier cover is moveable across said access opening.

8. The merchandiser cabinet according to claim 4, wherein said access opening is positioned in a vertically-oriented plane and said flexible barrier cover is moveable across said access opening.

9. A flexible barrier cover assembly for selectively covering the access opening of a refrigerated display cabinet to substantially exclude the ambient atmosphere therefrom comprising an energy conserving flexible barrier cover means, a support means for providing structural support for said barrier cover means, motive means for enabling movement of said flexible cover barrier means across said access opening to limit the entry of ambient air into said cabinet, a control means for actuating said motive means in response to the occurrence of selected cabinet nonuse conditions, and traction means arranged in association with said support means and wherein said traction means are connected to leading portions of said flexible barrier cover means and powered by said motive means to move said barrier cover means across said access opening.

10. The barrier cover assembly according to claim 9, wherein said traction means comprise at least one endless drive member and wherein said endless drive member is supported between an idler wheel and a powered drum or gear rotatably connected to said support means, and wherein connectors are attached between the leading portions of said flexible barrier cover means and said endless drive members to enable movement of said barrier cover means across said access opening and said powered drum or gear operably connected to said motive means.

11. The barrier cover assembly according to claim 10, wherein said support means is arranged for pivotal movement across said access opening.

12. The barrier cover assembly according to claim 7, wherein said support means comprise rotatable screw operators and wherein said traction means comprise follower sleeves having lugs fit to the threads on said screw operators, and wherein said screw operators are rotated by said motive means in response to said control means.

13. The barrier cover assembly according to claim 9, wherein said flexible barrier means is in sheet form and wherein a take-up reel is arranged for providing storage thereof in rolled form.

14. The barrier cover assembly according to claims 9 or 11 wherein said motive means comprises a first motor means for moving said support means and a second motor means for moving said traction means.

15. The barrier cover assembly according to claims 10, 11, 12 or 9 wherein a housing is provided for said barrier cover assembly and wherein said housing is positionable along an edge of said access opening for enabling unitary packaging of said flexible cover barrier, said traction means, said motive means, and said control means.

16. In a refrigeration display cabinet having outer walls defining a product display space and having an access opening in at least one of said walls for permitting products to be moved into and out of said display space; the improvement comprising:

a barrier assembly for selectively covering said access opening to substantially limit the entry of ambient atmosphere thereinto, said assembly comprising a flexible barrier means, a motive means enabling movement of said barrier means across said access opening, said motive means comprising support means arranged to pivot into said access opening to enable movement of said flexible barrier cover means across said access opening, a motor means for powering movement of said support means and said barrier cover means, and a control means for actuating said motive means in response to the occurrence of selected cabinet use conditions.

17. The improvement according to claim 16 further comprising traction means on said support means and wherein said support means comprises two support rails and said traction means on said support means comprise endless drive members, and wherein said drive members are each supported between an idler wheel and a power drum or gear which is rotatably connected to said support means and wherein connectors are attached to the leading portions of said flexible barrier means and to said endless drive members to enable movement of said barrier means across said access opening after said support rails have pivoted across said access opening, and said powered drum or gear operably connected to said motor means.

18. In a refrigeration display cabinet having outer walls defining a product display space and having an access opening in at least one of said walls for permitting products to be moved into and out of said display space; the improvement comprising:

a barrier assembly for selectively covering said access opening to substantially limit the entry of ambient atmosphere thereinto, said assembly comprising a flexible barrier means, a motive means enabling movement of said barrier means across said access opening, and a control means for actuating said motive means in response to the occurrence of selected cabinet use conditions; and wherein traction means are arranged on said support means and are connected to leading portions of said flexible barrier cover means and powered by said motive means to move said barrier cover means across said access opening.

19. In a refrigerated display cabinet having outer walls defining a product storage and display space containing refrigerated air and having an access opening in at least one wall thereof to provide for product access; the improvement comprising:

an energy conserving assembly including a flexible barrier cover arranged for covering at least a portion of said access opening and adapted for storage away from said access opening, a support means for providing structural support for enabling movement of said flexible barrier cover from the storage position across at least a portion of said access opening, motive means for powering the movement of said flexible barrier cover, and control means for automatically actuating said motive means in response to the occurrence of selected operational input conditions in the absence of operating personnel to enable movement of said barrier cover across said access opening whereby contact of ambient air with the refrigerated air contained within said product storage and display space is substantially limited, a core member for reeling said flexible barrier cover into a stored position, said core member being rotatably connected to said cabinet to enable the reeling in of said barrier and said motive means arranged to forcibly rotate said core member to enable reeling said barrier cover into the stored position, said support means comprising at least two rails for supporting said flexible barrier cover and each of said rails pivotally supported within said cabinet and movable between positions adjacent to the edges of said access opening, said support means including two pivoting means for moving each of said rails over arcs having centers located near two corners of said access opening, and traction means to enable movement of said flexible barrier cover across said access opening upon completion of movement of said pivoting means, said control means upon input of a cabinet non-use condition, controlling the movement of said pivoting means to enable each of said rails to move over pivot arcs away from stored positions adjacent to said access opening and across at least a portion of said access opening.

20. The improvement according to claim 19, wherein said control means upon input of a cabinet use condition, controls the power supplied to said traction means to enable movement of said cover rod back across said access opening and permits said core to reel said barrier cover into the storage position, and upon completion of the storage of said barrier cover said control means enables movement of said pivoting means to enable each of said rails to move back over the pivot arcs into storage positions adjacent to said access opening.

21. A flexible barrier cover assembly for selectively covering the access opening of a refrigerated display cabinet to substantially exclude the ambient atmosphere therefrom comprising an energy conserving flexible barrier cover means, a support means for providing structural support for said barrier cover means, said support means comprising at least two support arms aranged along two parallel sides of said access opening for enabling movement of said flexible barrier means across said access opening, motive means for enabling movement of said flexible barrier cover means across said access opening to limit the entry of ambient air into said cabinet, traction means arranged to operate on said support arms and connected to leading edge portions of said flexible barrier cover means, said motive means powering movement of said traction means, and a control means for actuating said motive means in response to the occurrence of selected cabinet non-use conditions.

22. A flexible barrier cover assembly for selectively covering the access opening of a refrigerated display cabinet to substantially exclude the ambient atmosphere therefrom comprising an energy conserving flexible barrier cover means, a support means for providing structural support for said barrier cover means, motive means for enabling movement of said flexible barrier cover means across said access opening to limit the entry of ambient air into said cabinet, a control means for automatically actuating said motive means in response to the occurrence of selected cabinet non-use input conditions in the absence of operating personnel, traction means arranged in association with said support means and connected to said motive means and said flexible barrier cover means to provide movement thereof, and a housing provided for said barrier cover assembly positioned along an edge of said access opening for enabling unitary packaging of said flexible barrier cover, said traction means, said motive means and said control means.

23. The barrier cover assembly according to claim 22, wherein said flexible barrier means is in sheet form and wherein a take-up reel is arranged for providing storage of said flexible barrier means in rolled form and wherein said reel is forceably rotated to reel said means into the storage position.

24. The barrier cover assembly according to claim 9, further comprising traction means arranged in association with said support means and wherein said motive means comprises a first motor means for moving said support means and a second motor means for moving said traction means.

* * * * *